US008573768B2

(12) United States Patent
Onishi et al.

(10) Patent No.: US 8,573,768 B2
(45) Date of Patent: Nov. 5, 2013

(54) RECORDING APPARATUS

(75) Inventors: Toru Onishi, Yokohama (JP); Sachi Matsui, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 157 days.

(21) Appl. No.: 13/278,928

(22) Filed: Oct. 21, 2011

(65) Prior Publication Data

US 2012/0098882 A1 Apr. 26, 2012

(30) Foreign Application Priority Data

Oct. 25, 2010 (JP) ..... 2010-238579
Oct. 25, 2010 (JP) ..... 2010-238685
Oct. 25, 2010 (JP) ..... 2010-238686

(51) Int. Cl.
*B41J 29/377* (2006.01)
*B41J 29/393* (2006.01)
*B41J 2/01* (2006.01)

(52) U.S. Cl.
USPC ..... 347/103; 347/18; 347/19

(58) Field of Classification Search
USPC ..... 347/18–20, 103
See application file for complete search history.

(56) References Cited

U.S. PATENT DOCUMENTS

2007/0176995 A1* 8/2007 Kadomatsu et al. ..... 347/103
2009/0079784 A1* 3/2009 Chiwata et al. ..... 347/21

FOREIGN PATENT DOCUMENTS

JP 2009-045885 A 3/2009

* cited by examiner

*Primary Examiner* — Jason Uhlenhake
(74) *Attorney, Agent, or Firm* — Canon U.S.A., Inc., IP Division

(57) ABSTRACT

In a transfer inkjet recording system, a cooling unit is configured to independently cool multiple locations in a region in which an intermediate image of an intermediate transfer medium is formed in accordance with one of a temperature of the intermediate transfer medium after being heated by a heating unit or in accordance with image data.

18 Claims, 16 Drawing Sheets

RECORDING APPARATUS

BACKGROUND OF THE INVENTION

1. Field of the Invention

The present invention relates to a recording apparatus with a transfer inkjet recording system.

2. Description of the Related Art

Japanese Patent Laid-Open No. 2009-045885 discloses a recording apparatus with a transfer inkjet recording system. In the recording apparatus, an intermediate image (i.e., an ink image) is once formed on an intermediate transfer medium by an inkjet method, and then the formed intermediate image is transferred to a recording medium. Since ink viscosity of the intermediate image is important for good transfer, ink viscosity is increased by heating the intermediate image formed on the intermediate transfer medium by, for example, a heater so as to let an ink solvent evaporate. In the apparatus disclosed in Japanese Patent Laid-Open No. 2009-045885, a surface of the intermediate transfer medium is cooled by applying a coolant after the transfer. Formation of images on the recording medium is repeated by a series of processes of forming an intermediate image, heating, transferring and cooling is repeated as one recording cycle.

FIG. 1A illustrates, in a sectional view, heating of a high duty region (which is a region in which a surface of an intermediate transfer medium is covered densely by ink) in an intermediate image. Most of the heat W (represented by a bold arrow in FIG. 1A) applied from above by a heater is taken away as the heat of evaporation for the evaporation of an ink solvent with a coloring material left. For this reason, the intermediate transfer medium itself is not heated excessively and thus temperature rise is slow. On the contrary, as illustrated in FIG. 1B, when the heat W is applied to a low duty region (which is a region in which the surface of the intermediate transfer medium is covered less densely by ink) in the same intermediate image, the amount of heat of evaporation during the evaporation of the ink solvent is small; thus a greater amount of heat is transferred to the intermediate transfer medium than the configuration illustrated in FIG. 1A, and thus temperature rise is steep. With this mechanism, even in the same intermediate image formation region, difference in temperature occurs between the surface of the intermediate transfer medium in the high duty region and the surface of the intermediate transfer medium in the low duty region after a heating process. The difference in temperature exists in subsequent recording cycles.

The difference in temperature is not eliminated in a short time even if the intermediate transfer medium is cooled after the transfer process as in the configuration disclosed in Japanese Patent Laid-Open No. 2009-045885. If the subsequent recording cycle is begun with the difference in temperature has not been eliminated, "insufficient transfer" is more likely to occur in the mechanism described below.

SUMMARY OF THE INVENTION

The applicant has found a phenomenon that, when an intermediate image formed on an intermediate transfer medium is heated, the surface of the intermediate transfer medium has different temperature depending on the location. A mechanism thereof will be described.

Suppose that the entire intermediate image formation region is cooled uniformly with a cooling amount with which the surface of the intermediate transfer medium (with relatively low temperature) in the high duty region is sufficiently cooled in the intermediate transfer medium on which difference in temperature depending on the location occurs after the transfer process. Then, the low duty region, which is higher in temperature, is not completely cooled and partially keeps temperature higher than the predetermined temperature even after the cooling. In the subsequent recording cycle, the solvent of the ink landed on the region of abnormally high temperature on the intermediate transfer medium begins evaporating due to the heat of the intermediate transfer medium before being heated by a heater. It is possible that the ink solvent excessively evaporates with the effect of the subsequent heating process, whereby the ink viscosity increases over an allowable range. In the transfer process, the ink with excessively high viscosity strongly adheres to the intermediate transfer medium; thus, the ink is not completely transferred to the recording medium by the usual transfer pressure and, as a result, "image blur" is produced in the transferred image. "Image blur" is one form of "insufficient transfer."

On the contrary, suppose that the entire intermediate image formation region is cooled uniformly with the cooling amount with which the surface of the intermediate transfer medium (with relatively high temperature) in the low duty region is sufficiently cooled. Then, the high duty region is excessively cooled and partially keeps temperature lower than the predetermined temperature even after the cooling. In the subsequent recording cycle, heat of the ink landed on the region of abnormally low temperature on the intermediate transfer medium is taken away by the low-temperature intermediate transfer medium during the heating process. Therefore, evaporation of the ink solvent is insufficient with a predetermined heating amount; thus, it is possible that the ink viscosity fails to reach an allowable range. In the transfer process, the ink with insufficient viscosity spreads in a wide range on the recording medium by the transfer pressure, thereby causing "image depletion" on the transferred image. Another form of "insufficient transfer" is "image depletion."

The present invention has been made in view of the aforementioned circumstances. The present invention provides a recording apparatus with a transfer inkjet recording system which can prevent occurrence of insufficient transfer in subsequent recording cycles by reducing difference in temperature, which is produced in a heating process, depending on the location of an intermediate transfer medium.

The present invention is a recording apparatus, comprising: an intermediate transfer medium; a recording head configured to apply ink to the intermediate transfer medium in accordance with image data to form an intermediate image; a heating unit configured to heat the intermediate image formed on the intermediate transfer medium; a transfer unit configured to transfer the intermediate image heated by the heating unit to a recording medium; and a cooling unit configured to cool the intermediate transfer medium heated by the heating unit, wherein the cooling unit is further configured to cool multiple locations of the intermediate transfer medium independently in accordance with one of the temperature of the intermediate transfer medium after being heated by the heating unit or in accordance with the image data.

Further features according to the present invention will become apparent from the following description of exemplary embodiments with reference to the attached drawings.

DESCRIPTION OF THE EMBODIMENT

Embodiment 1-a

First, independent cooling of multiple locations of an intermediate transfer medium in a region in which an intermediate image is formed will be described in detail.

Figure 2:
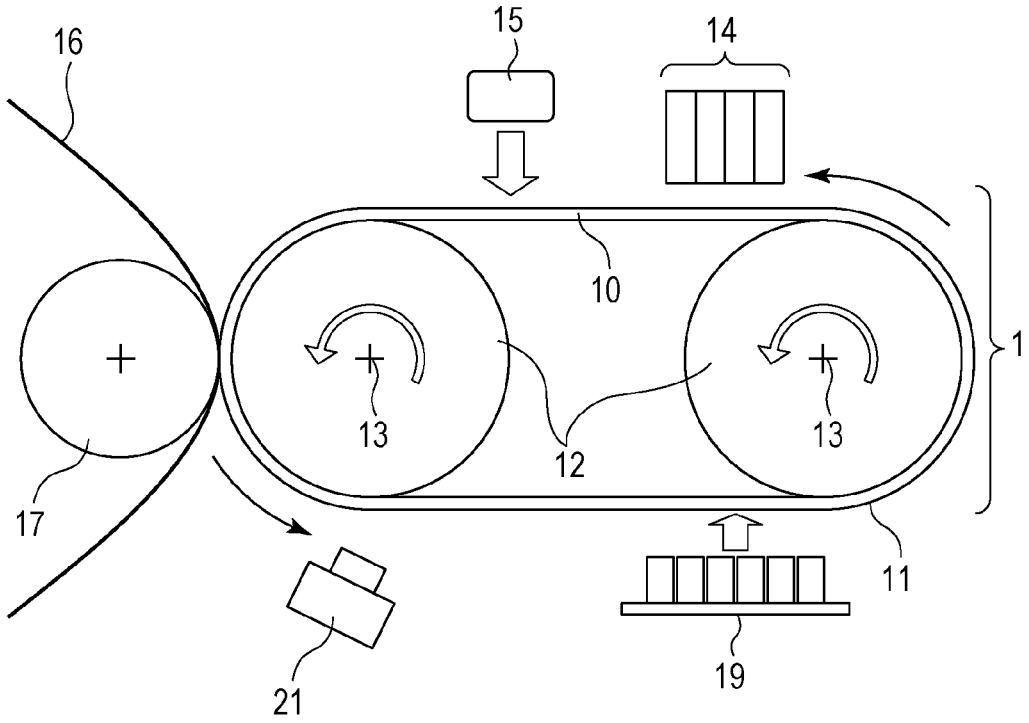
FIG. 2 illustrates, in a sectional view, an entire configuration of a recording apparatus according to Embodiments 1-a and 1-b.

FIG. 2 illustrates an entire configuration of a recording apparatus of a transfer inkjet recording system according to Embodiment 1. An intermediate transfer medium 1 includes two drum-shaped rotary members 12 and a seamless transfer belt 10; the drum-shaped rotary members 12 rotate in a direction of the arrows about axes 13 and the transfer belt 10 is rotated around the two rotary members 12. The transfer belt 10, made of a metallic material, includes an ink-receiving surface layer 11 on an outer surface thereof.

A group of units is disposed around the intermediate transfer medium 1 to repeatedly implement recording cycles, each of which consisting of forming, heating, transferring and cooling of an intermediate image. These units are a recording head 14 (for an intermediate image formation process), a heating section 15 (for a heating process), a transfer roller 17 (for a transfer process) and a cooling section 19 (for a cooling process). The recording head 14 includes multiple linear inkjet heads each corresponding to multiple colors. The ink ejected from multiple nozzles of the inkjet head is applied to the intermediate transfer medium 1 (i.e., the surface layer 11 of the transfer belt 10) to form the intermediate image (i.e., an ink image). The heating section 15 includes a heater which generates electromagnetic waves including heat rays, such as infrared rays and far-infrared rays, and heats the surface layer 11 by direct irradiation of heat rays or blowing of warm air. An ink solvent of the intermediate image formed on the intermediate transfer medium 1 is heated to evaporate so as to increase viscosity of the ink. The transfer roller 17 presses the ink with increased viscosity on the intermediate transfer medium 1 against a recording medium 16 and applies pressure thereto; thus, an image is transferred to the recording medium 16. The cooling section 19 lets the intermediate transfer medium, after the transfer process, be cooled to the initial temperature in a short time in order to shorten the time required for one recording cycle. The cooling section 19 includes multiple cooling elements each of which cooling capacity can be controlled independently; and thus the cooling section 19 is capable of separately cooling regions to be cooled, which will be described later.

Figure 3:
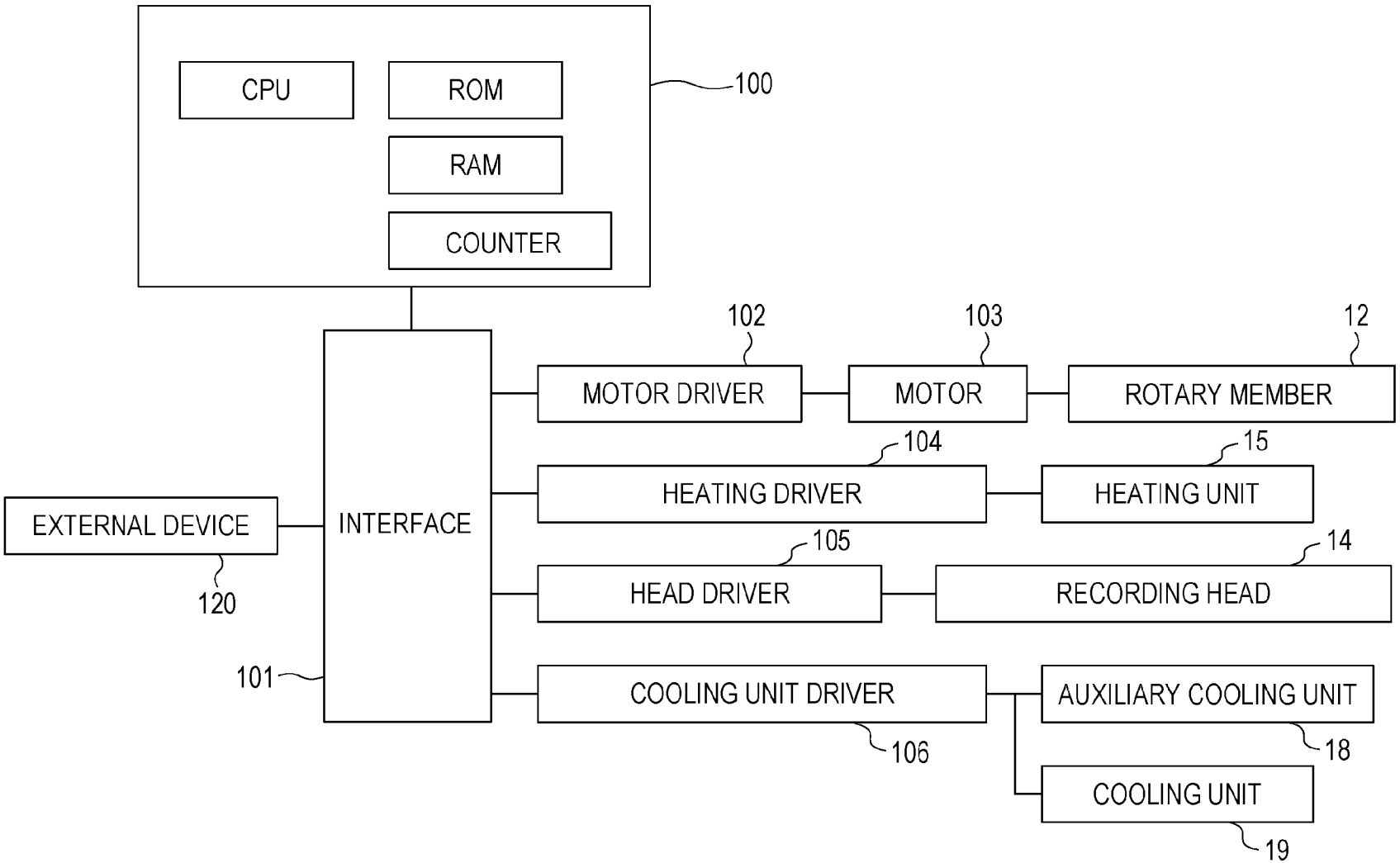
FIG. 3 is a block diagram of a control system.

FIG. 3 illustrates, in a block diagram, a control system of the recording apparatus according to the present embodiment. A control unit 100, which is a controller, includes a CPU, ROM, RAM and a counter. The ROM stores control programs that the CPU executes. The RAM includes a working area and a buffer area; data, such as image data, are temporarily stored on the working area and various data input from an external device 120 is stored in the buffer area. The counter counts the number of driving pulses of a motor which drives the rotary member 12. A motor driver 102, a heating section driver 104, a head driver 105 and a cooling section driver 106 are connected to the control unit 100 via an interface 101. The motor driver 102 drives a motor 103 which lets the rotary member 12 rotate. A heating state of the heating section 15 is controlled via the heating section driver 104. The head driver 105 drives an ink ejection nozzle of the recording head 14. Cooling sections 18 and 19 are controlled by the cooling section driver 106.

An image transfer operation in the thus-configured apparatus will be described in the process order.

Figure 1A:
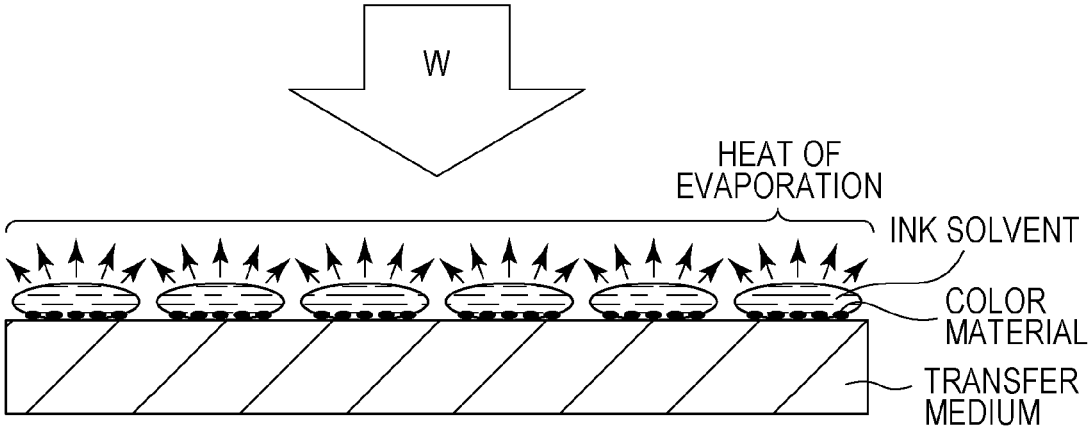
FIGS. 1A and 1B illustrate a phenomenon that surface temperature of an intermediate transfer medium varies depending on the location.
Figure 1B:
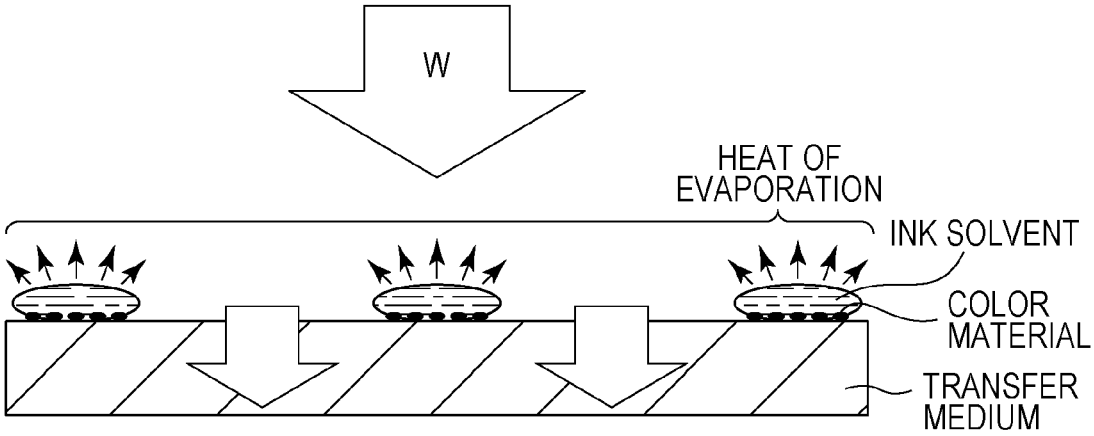

The intermediate transfer medium 1 is rotated in the direction of arrow of FIG. 1; during the rotation, ink is ejected from the recording heads 14 in accordance with the image data and an intermediate image is formed on the surface layer 11 of the transfer belt 10 (i.e., an intermediate image formation process). The image data, supplied from the external device 120, is digital data corresponding to an image to be recorded.

Figure 4A:
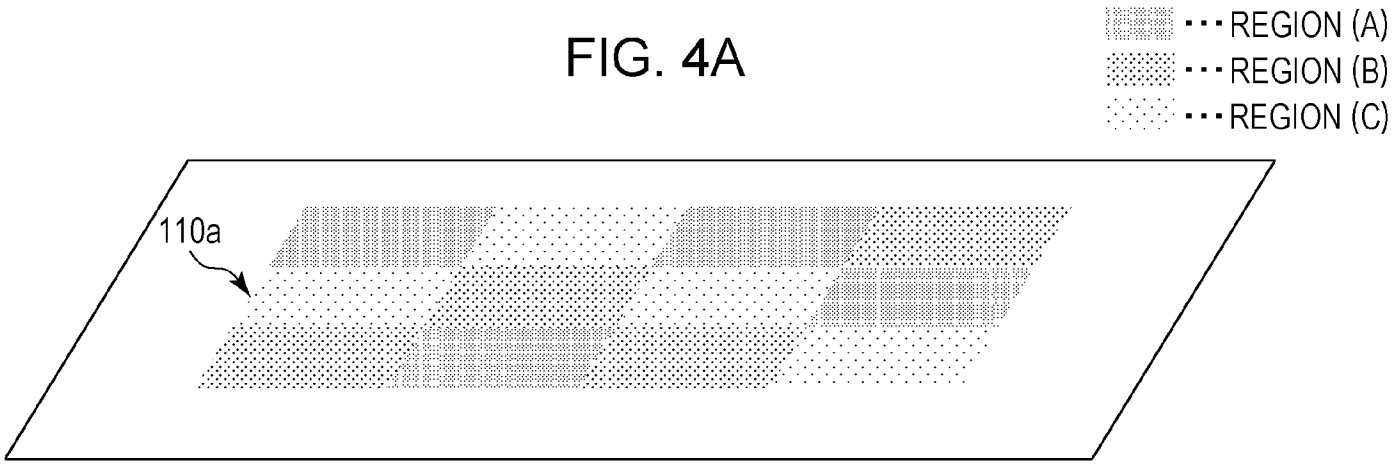
FIGS. 4A and 4B illustrate an intermediate image divided on an intermediate transfer medium.
Figure 7:
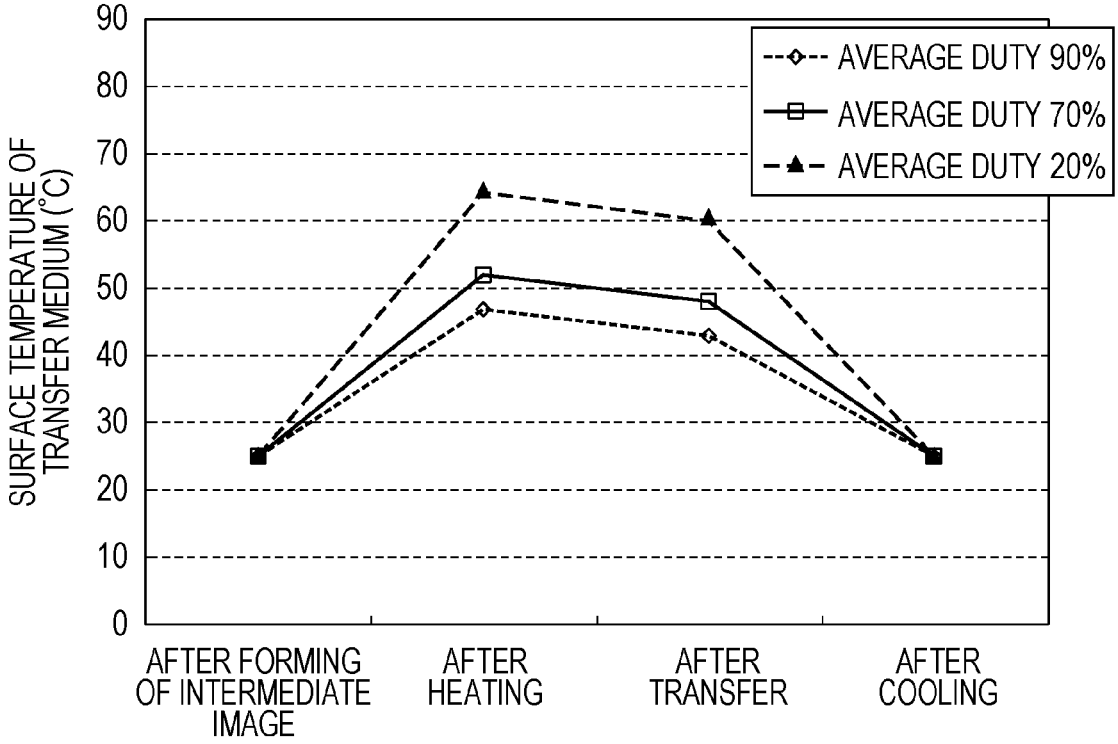
FIG. 7 is a graphic plot of transition of surface temperature of the intermediate transfer medium of each recording duty immediately after undergoing each process according to Embodiment 1-a.

In FIG. 4A, a dot region 110*a* represents an example of the intermediate image formed on the intermediate transfer medium 1. Density of the points indicates the size of the recording duty of the image. Here, the "recording duty" is the ratio of the actual ejection events with respect to the maximum possible ejection events in a single scanning event. For example, if one dot is formed in one ejection event, the ratio of the dot number actually formed with respect to the number of pixels recordable in one scanning region corresponds to the recording duty. The control unit 100 is capable of acquiring information about the recording duty corresponding to the region within the image by computation from the image data. In this example, three regions with difference in density are included in the dot region 110*a:* an image region (A) with recording duty of 90%; an image region (B) with recording duty of 70%; and an image region (C) with recording duty of 20%. Although the number of image regions herein is three for ease of understanding, actual image, in many cases, is constituted by a greater number of recording duties. Surface temperature of the intermediate transfer medium is substantially the ambient temperature (i.e., the initial temperature) before and after the first intermediate image formation process. FIG. 7 is a graphic plot of transition of the surface temperature of the intermediate transfer medium of each recording duty immediately after undergoing each process. In this example, temperature before and after the intermediate image formation process is 25 degrees C. in the image region with recording duty of 90%, is 25 degrees C. in the image region with recording duty of 70% and is 25 degrees C. in the image region with recording duty of 20%.

The intermediate image formed on the intermediate transfer medium 1 in the intermediate image formation process is heated by the heating section 15 to evaporate the ink solvent, thereby increasing viscosity of ink (i.e., the heating process). The heating section 15 blows warm air of, for example, 120 degrees C. in temperature and 5 m/s in wind velocity uniformly on the surface layer 11.

Then, in the transfer unit, the transfer belt 10 and the recording medium 16 are nipped between the transfer roller 17 and the rotary member 12, and the transfer roller 17 is driven to rotate under appropriate nip pressure. Thus, the intermediate image with ink of which viscosity has been increased appropriately in the heating process is transferred to the recording medium 16 (i.e., the transfer process).

Figure 4B:
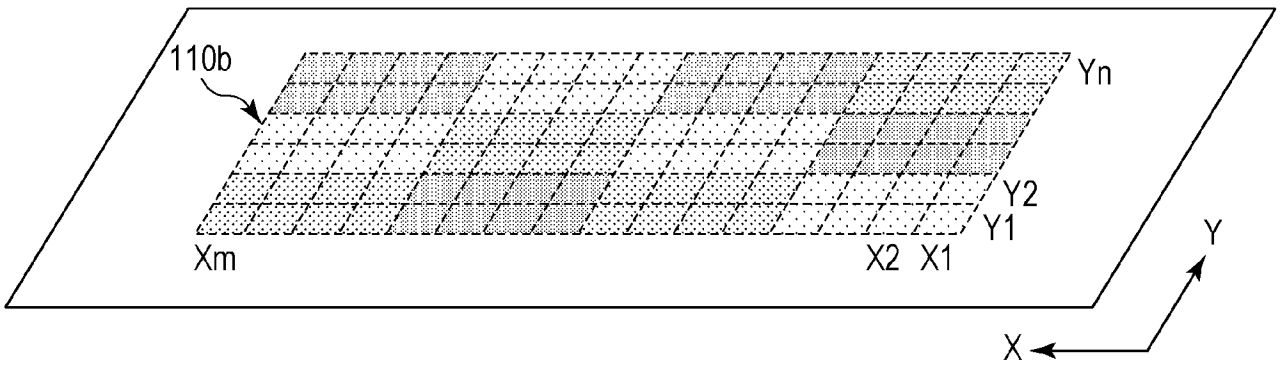

Herein, the region in the intermediate transfer medium in which the intermediate image has been formed before an image is transferred is called "region after the transfer process of the intermediate image." With the mechanism described above, the region after the transfer process of the intermediate image has non-uniform temperature distribution after the heating process in accordance with the recording duty of the image and has locations with difference in temperature. In this example, temperature after the heating process is, as illustrated in FIG. 7, 47 degrees C. in a divided region with recording duty of 90%, is 52 degrees C. in a divided region with recording duty of 70% and is 65 degrees C. in a divided region with recording duty of 20%. As shown in FIG. 4B, the region after the transfer process of the intermediate image is divided into multiple locations of predetermined size and average temperature of each divided area is acquired under the control of the control unit 100. For example, the region of a single image is divided into (n×m) blocks, and temperature information is acquired for each block as a unit. For acquisition of temperature information, a temperature sensor 21 is provided in the downstream of the transfer roller 17; the temperature sensor 21 acquires average temperature of each divided region directly. The temperature sensor 21 may be, for example, a collection of a thermographic sensor which detects two-dimensional temperature distribution and a temperature sensor which detects spot temperature of a narrow range. In this example, temperature after the transfer process is, as illustrated in FIG. 7, 42 degrees C. in a divided region with recording duty of 90%, is 48 degrees C. in a divided region with recording duty of 70% and is 60 degrees C. in a divided region with recording duty of 20%.

Figure 5:
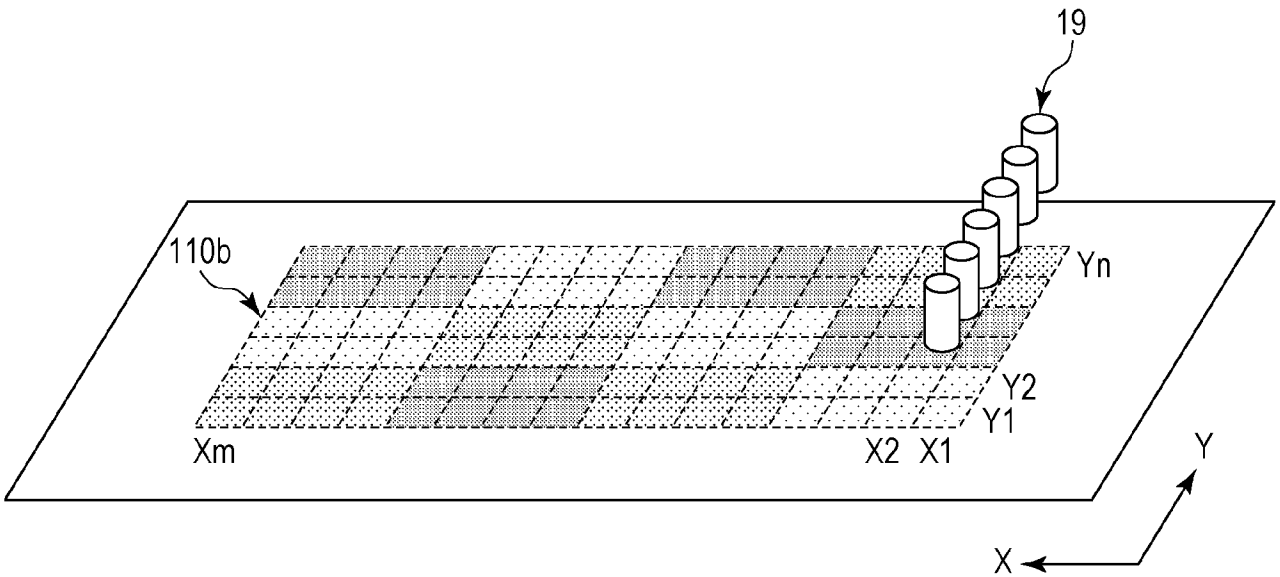
FIG. 5 illustrates an arrangement of a cooling element in a cooling section or a heating element in a heating section.
Figure 6A:
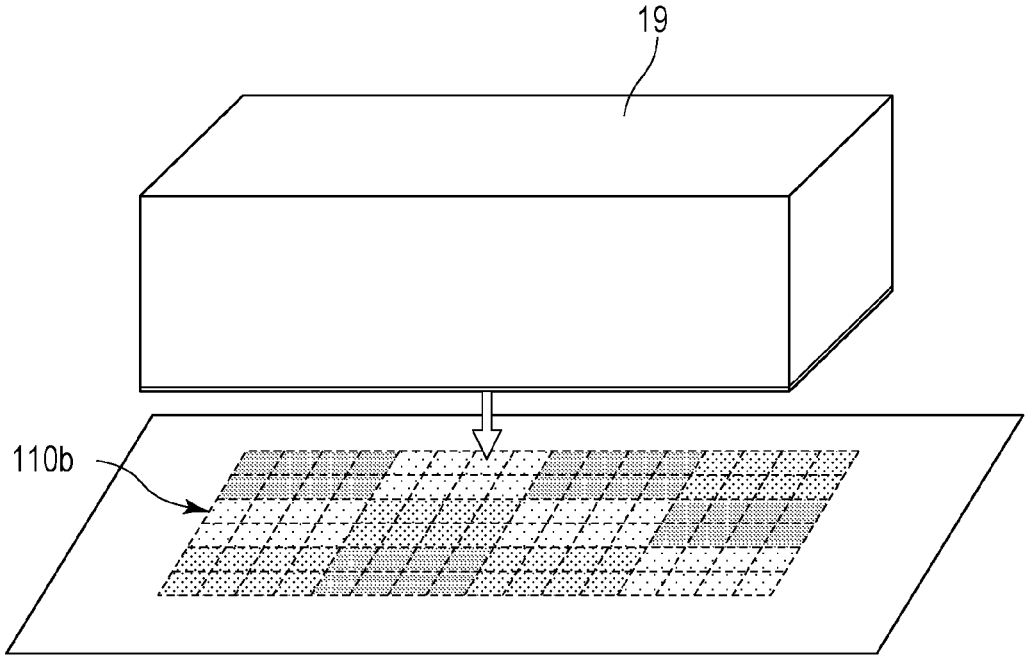
FIGS. 6A and 6B illustrate another form of the cooling section.
Figure 6B:
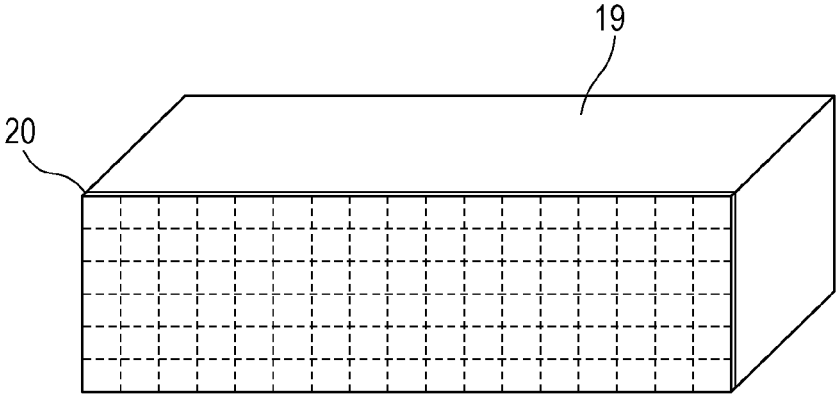

Then, the region after the transfer process of the intermediate image is cooled to desired temperature by the cooling section 19 (i.e., the cooling process). This cooling process is one of important points in the present embodiment, and will be described to detail below. As illustrated in FIG. 5, the cooling section 19 includes multiple cooling elements arranged linearly along a direction perpendicular to the conveyance direction (i.e., a Y direction); one or more cooling elements correspond to each of the divided regions of the region after the transfer process of the intermediate image which faces the Y direction. The cooling element is not necessarily arranged linearly but may be arranged in a two-dimensional matrix. Each cooling element includes a nozzle for blowing cooling fluid (gas or liquid) on the surface of the intermediate transfer medium. The cooling capacity can be controlled by varying fluid flow and/or fluid temperature blown from the nozzle. Alternatively, the cooling section 19 may be a cooling block member with large heat capacity as illustrated in FIGS. 6A and 6B which is brought into physical contact with the surface of the intermediate transfer medium 1 as illustrated in FIG. 6A. Cooling elements 20 which are multiple contact bodies provided with contact surfaces are formed on the undersurface of the cooling block member in a two-dimensional matrix arrangement as illustrated in FIG. 6B. Cooling mechanisms, such as Peltier device and a liquid path through which a cooling medium flows are incorporated corresponding to each cooling element 20. This allows independent control of a cooling amount (i.e., the surface temperature of the contact surface of the cooling element).

The control unit 100 controls capability of each cooling element, in accordance with temperature information detected by the temperature sensor 21, such that each of the regions after the transfer process of the intermediate image divided along the Y direction has an appropriate cooling amount in synchronization with the timing at which each divided region passes below the cooling element of the cooling section 19. The control unit 100 controls the cooling amount (i.e., an amount of airflow blown out of the nozzle and/or temperature of coolant gas) of each cooling element such that the location of the surface of the intermediate transfer medium with higher temperature has an increased cooling amount. For example, as illustrated in FIG. 5, the three regions have temperature in the order of the region (C)>the region (B)>the region (A) at the moment at which a row of X1 which is the first row passes by the cooling section 19; therefore, the cooling amount by corresponding cooling elements are also in the order of the region (C)>the region (B)>the region (A). The divided regions which face the cooling element are changed in the order of rows X1, X2, . . . , Xm 2 in the X direction accompanying the movement of the intermediate transfer medium. The control unit 100 controls the cooling amount of each cooling element in synchronization with the movement of the intermediate transfer medium; this allows independent cooling of each divided region also in the X direction.

Therefore, each of the multiple locations in the region after the transfer process of the intermediate image is cooled independently in accordance with temperature of the intermediate transfer medium after being heated by the heating section. The cooling process provides substantially uniform temperature distribution on the surface of the intermediate transfer medium at least in the region after the transfer process of the intermediate image. Cooling is performed to an average temperature at which temperature of the intermediate transfer medium itself does not induce evaporation of the ink solvent in the subsequent recording cycle, e.g., the ambient temperature (i.e., the initial temperature). In this example, temperature after the cooling process is, as illustrated in FIG. 7, 25 degrees C. in a region with recording duty of 90%, is 25 degrees C. in a region with recording duty of 70% and is 25 degrees C. in a region with recording duty of 20%.

Instead of acquiring the temperature information by the temperature sensor 21, multiple locations in the region after the transfer process of the intermediate image of the intermediate transfer medium may be cooled independently in accordance with the image data of the intermediate image. The control unit 100 is capable of acquiring information about the average recording duty for each divided region in the image from the image data by computation. A data table in which the recording duty and the required cooling amount are correlated with each other is obtained experientially and is stored in memory of the control unit 100 in the form of a data table. The control unit 100 analyzes the image data and obtains information about the average recording duty for each divided region. The control unit 100 then acquires a cooling amount appropriate to the obtained recording duty with reference to the data table. That is, the control unit 100 acquires information about the recording duty corresponding to each of the multiple locations from the image data, and controls each of the cooling elements such that the cooling amount of a location with relatively low recording duty is greater than that of a location with high recording duty. This allows the surface of the intermediate transfer medium to have substantially uniform temperature distribution in the region after the transfer process of the intermediate image.

With the thus-configured Embodiment 1-a, occurrence of insufficient transfer in subsequent recording cycles can be prevented by independent cooling to reduce difference in temperature depending on locations on the intermediate transfer medium produced in the heating process.

Embodiment 1-b

Embodiment 1-b of the present invention will be described. Embodiment 1-b differs from Embodiment 1-a in the heating section 15; other components are the same as those illustrated in FIG. 2. In Embodiment 1-b, not as in the configuration of Embodiment 1-a in which the intermediate image is heated uniformly in the heating process, the image is divided into multiple regions and the heating amount is controlled independently for each of the divided regions.

The heating amount required to achieve "appropriate ink viscosity" after the heating process differs depending on the average recording duty of each divided region of the image. "Appropriate ink viscosity" herein is the viscosity of ink before the transfer process; at that viscosity, no "insufficient transfer", such as "image blur" and "image depletion," occurs in the image transferred to the recording medium.

Figure 8A:
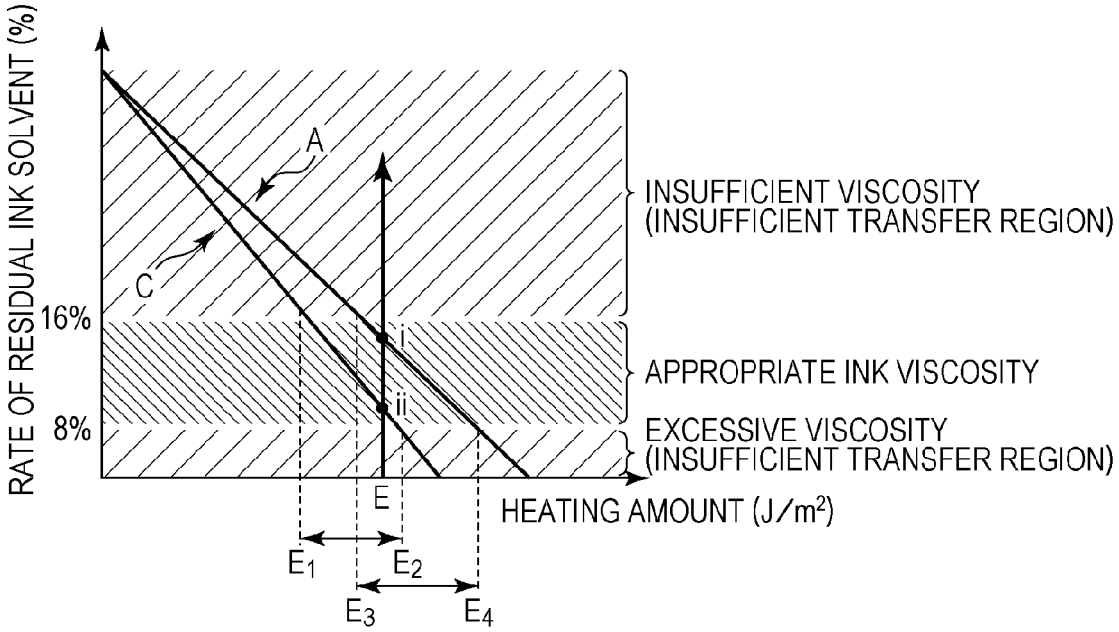
FIGS. 8A and 8B are graphic plots of a rate of residual ink solvent with respect to a heating amount.
Figure 8B:
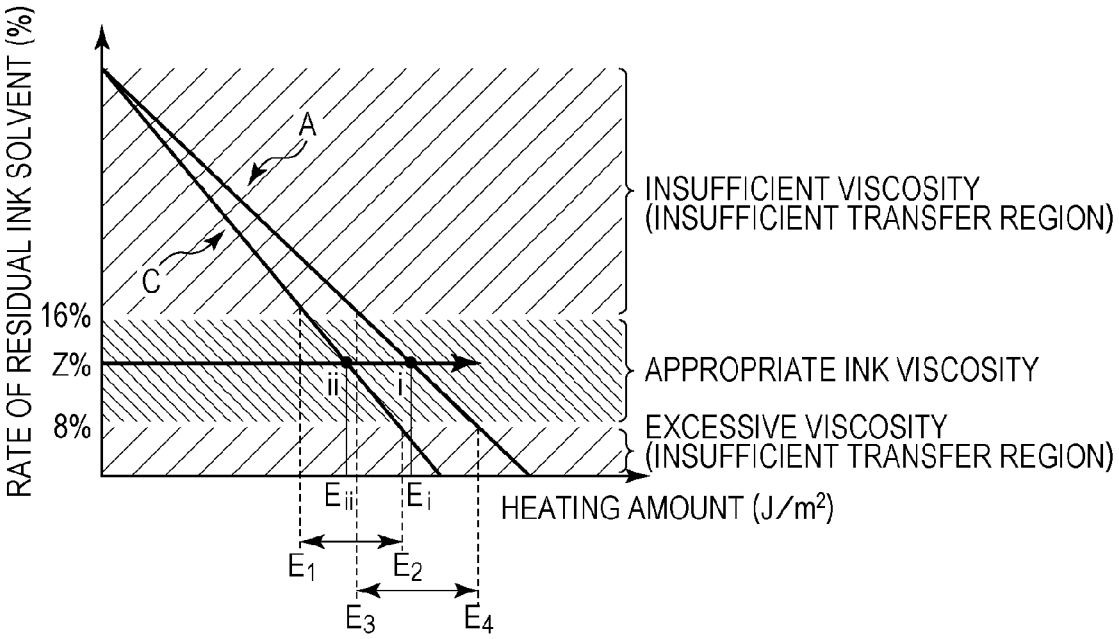

FIGS. 8A and 8B are graphic plot of a residual rate (%) of the ink solvent with respect to the heating amount in the intermediate image with the amount of solvent containing at the time of preparation of ink being as a standard (100%). The region (A) with recording duty of 90% and the region (C) with recording duty of 20% are represented by the graph. The ink solvent evaporates gradually during the heating process. The "appropriate ink viscosity" is achieved when the residual rate (%) becomes in a predetermined range. In this example, the "appropriate ink viscosity" is 16% to 8% of the residual rate of the ink solvent. As the graph shows that the region (A) and the region (C) have different heating amount required to reach the "appropriate ink viscosity." That is, when the intermediate image is heated uniformly, the "appropriate ink viscosity" is achieved in the heating amount of between $E_1$ and $E_2$ in the region (C) while in the heating amount of between $E_3$ and $E_4$ in the region (A). Thus, the heating amount required to achieve the "appropriate ink viscosity" differs depending on the recording duty.

If the image is heated uniformly by the heating section as in the configuration of Embodiment 1-a, a heating amount is determined such that the both the minimum recording duty region and the maximum recording duty region achieve the "appropriate ink viscosity." In the example of FIG. 8A, the entire image achieves the "appropriate ink viscosity" by applying a heating amount E which is between the amounts of heat $E_3$ and $E_2$. The maximum recording duty region and the minimum recording duty region are in an allowable range of the "appropriate ink viscosity," but are different in ink viscosity. That is, the maximum recording duty region has ink viscosity (represented by point i) near an upper insufficient transfer region (i.e., the ink viscosity with insufficient viscosity) while the minimum recording duty region has ink viscosity (represented by point ii) near a lower insufficient transfer region (i.e., excessively high viscosity). It is therefore possible that an increase in recording quality is inhibited when an image with high gradient, such as a photographic image, is recorded.

In Embodiment 1-b, on the contrary, the ink viscosity (i.e., the residual rate (%) of the ink solvent after the heating process (Z%)) at which the transfer of the highest quality is achieved among the allowable range of the "appropriate ink viscosity" is determined as illustrated in FIG. 8B. The intermediate image is not heated uniformly but the heating amount is independently controlled for each region such that the residual ink solvent after the heating process is substantially Z% in all the regions of the image. In the example of FIG. 8B, the amounts of heat $E_i$ and $E_{ii}$ are obtained for the regions (A) and (C) respectively with which the residual rate of the ink solvent is Z%.

The heating section 15 provides, by each of the heating elements, different heating amount depending on the thus-obtained recording duty. In particular, a data table in which the recording duty and the required heating amount are correlated with each other is obtained experientially and is stored in memory of the control unit 100 in the form of a data table. The control unit 100 analyzes the image data and obtains average recording duty for each divided region. The control unit 100 then acquires a heating amount appropriate to the obtained recording duty with reference to the data table. If each heating element is controlled to be driven to achieve the acquired heating amount, the intermediate image has the most desirable ink viscosity among the "appropriate ink viscosity" and substantially uniform distribution. The surface temperature distribution of the intermediate transfer medium is also non-uniform, differing depending on the location though not the same as that of Embodiment 1-a.

The heating section 15 includes heating elements arranged linearly or in two-dimensional matrix, i.e., the same arrangement as that of the cooling element illustrated in FIG. 5. Each heating element includes a heater therein and is capable of controlling heating amount generation independently. Also when the intermediate image passes below the heating section 15, the control unit 100 drives, in the same manner as that illustrated in FIG. 5, FIG. 6A or FIG. 6B, each heating element such that the heating amount generated by each heating element is varied in synchronization with the movement of the intermediate transfer medium in the X direction; thus the control unit 100 provides an appropriate heating amount for each divided region.

Figure 9:
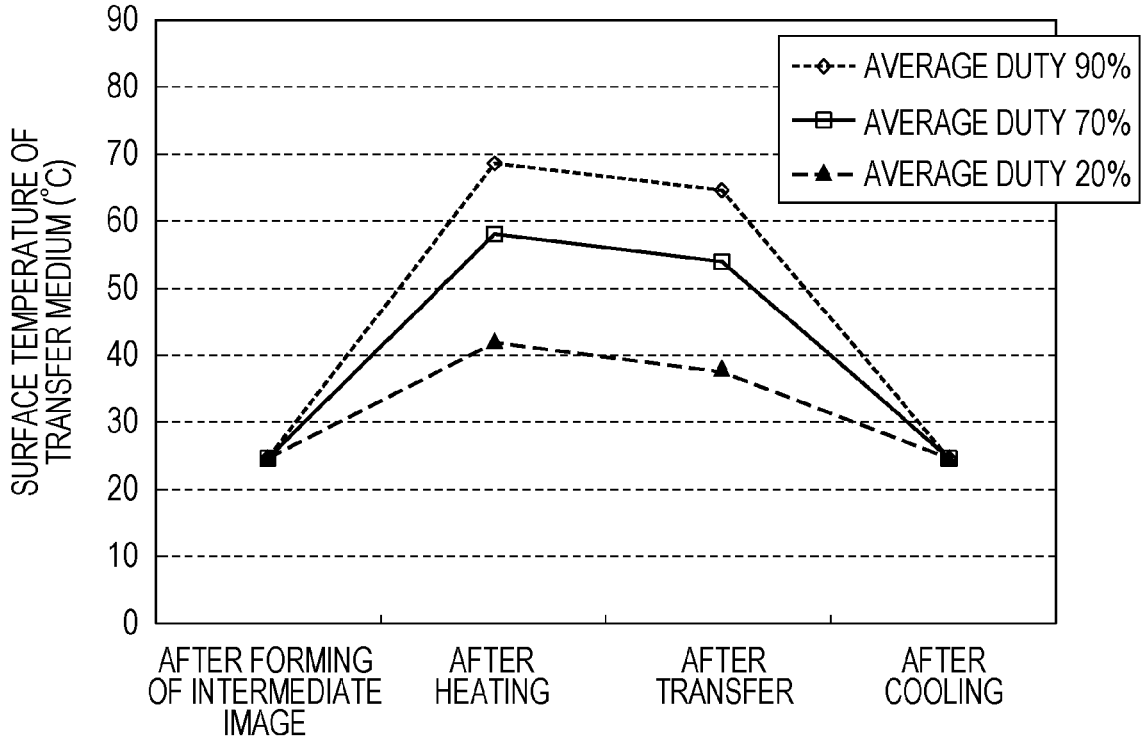
FIG. 9 is a graphic plot of transition of surface temperature of the intermediate transfer medium of each recording duty immediately after undergoing each process according to Embodiment 1-b.

FIG. 9 is a graphic plot of transition of the surface temperature of the intermediate transfer medium of each recording duty immediately after undergoing each process. As in the configuration of Embodiment 1-a, the temperature before and after the intermediate image formation process is uniformly 25 degrees C. regardless of the recording duty. The surface temperature of the intermediate transfer medium after the heating process is 69 degrees C. in the image region with recording duty of 90%, is 58 degrees C. in the image region with recording duty of 70% and is 42 degrees C. in the image region with recording duty of 20%. Highness and lowness of the temperature of the high duty region and the temperature of the low duty region are reversed in this example as described above as compared with the configuration in which the intermediate image is heated uniformly (Embodiment 1-a); however, there is still difference in temperature. It is therefore necessary to eliminate the difference in temperature in the cooling process.

Subsequently, the intermediate image proceeds to the transfer process and the cooling process in this order. In the cooling process, the region after the transfer process of the intermediate image on the surface of the intermediate transfer medium has a substantially uniform temperature distribution by providing an appropriate cooling amount to each of the divided regions as in the configuration of Embodiment 1-a. In accordance with temperature of the intermediate transfer medium after being heated by the heating section 15 or in accordance with the image data, the cooling section 19 independently cools multiple locations in the region in which the intermediate image is formed on the intermediate transfer medium. In this example, temperature after the cooling process is, as illustrated in FIG. 7, 25 degrees C. in a region with recording duty of 90%, is 25 degrees C. in a region with recording duty of 70% and is 25 degrees C. in a region with recording duty of 20%.

As described above, multiple locations in the region in which the intermediate image is formed is heated independently in accordance with the image data in Embodiment 1-b. In the subsequent cooling process, independent cooling is performed in order to reduce the difference in temperature depending on the location of the intermediate transfer medium produced in the heating process. This produces the following operation and effect in addition to those of Embodiment 1-a. That is, by independently heating each of the divided multiple locations, the residual ink solvent after the heating process is substantially Z% regardless of recording duty as described in FIG. 8B. That is, since the most desirable ink viscosity among the "appropriate ink viscosity" is uniformly obtained, recording quality of images, such as photographic images, is increased as compared with the configuration of Embodiment 1-a. From the viewpoint of energy consumption, Embodiment 1-b is advantageous to Embodiment 1-a in that the reduced heating amount in the low duty region results in the reduced amount of the entire energy.

Embodiment 2

Next, independent cooling of regions in each of which an intermediate image is formed on the intermediate transfer medium will be described in detail.

Figure 10A:
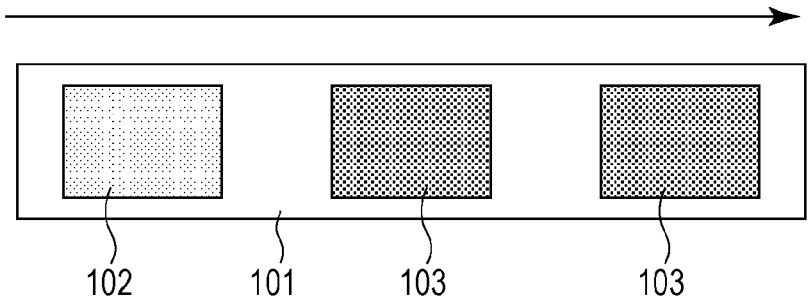
FIGS. 10A to 10D illustrate, in top views, intermediate images formed on an intermediate transfer medium according to Embodiment 2.

In FIG. 10A, two types of dot regions represent examples of intermediate images immediately after being formed on the intermediate transfer medium 1. Intermediate images 103 are high duty images with average recording duty of the entire image of 90% (i.e., a first intermediate image) and an intermediate image 102 is a low duty image with average recording duty of 20% (i.e., a second intermediate image). The first intermediate image and the second intermediate image herein are ink images formed at different locations on the transfer medium. Here, the "recording duty" is the ratio of the actual ejection events with respect to the maximum possible ejection events in a single scanning event. For example, if one dot is formed in one ejection event, the ratio of the dot number actually formed with respect to the number of pixels recordable in one scanning region corresponds to the recording duty. A control unit 50 is capable of acquiring information about the recording duty of a corresponding image by computation from image data. Images of two recording duty values are included in this example: the image 102 with the recording duty value of 20% and the image 103 with the recording duty value of 90%. Although the number of recording duty values herein is two for ease of understanding, images with a greater number of different recording duty values may be formed on the intermediate transfer medium in each recording cycle.

Figure 11:
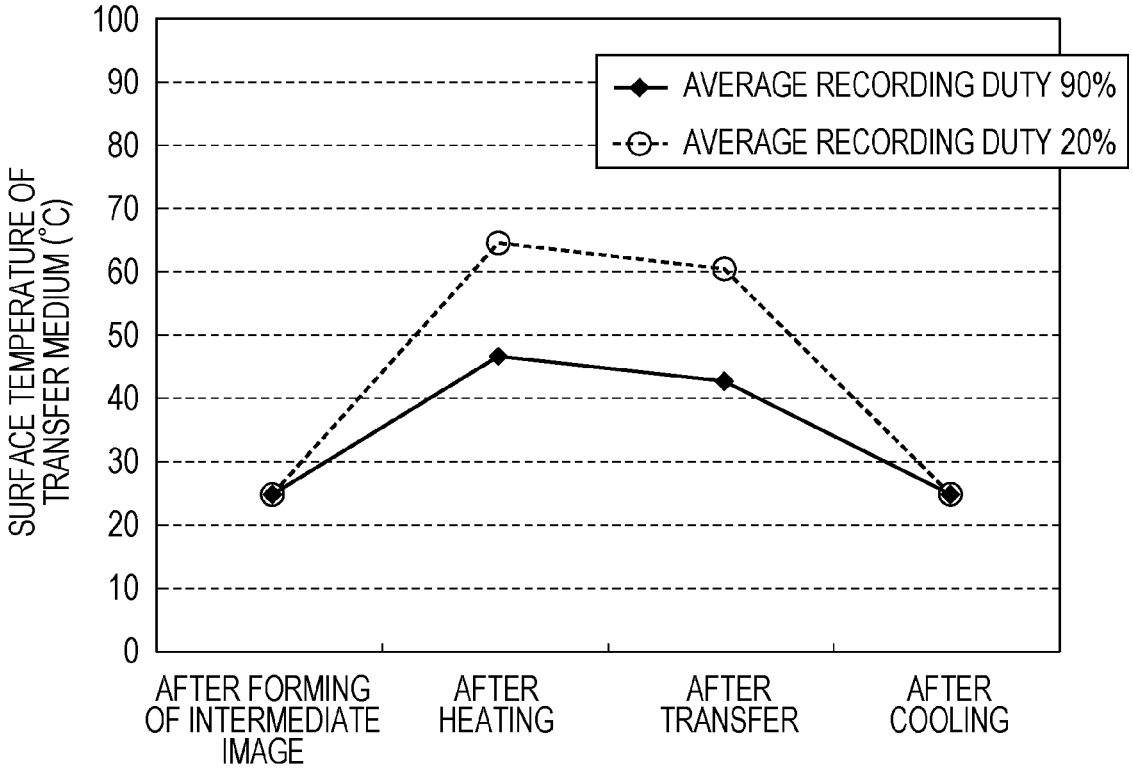
FIG. 11 is a graphic plot of transition of surface temperature of the intermediate transfer medium according to Embodiment 2.

Surface temperature of the intermediate transfer medium is substantially the ambient temperature (i.e., the initial temperature) before and after the first intermediate image formation process. FIG. 11 is a graphic plot of temperature of a surface of the intermediate transfer medium on which the intermediate image 102 and the intermediate image 103 immediately after undergoing each process are formed. In this example, temperature before and after the intermediate image formation process is 25 degrees C. in an intermediate transfer medium region in which an image with a recording duty value of 90% is formed (i.e., the first region) and is 25 degrees C. in an intermediate transfer medium region in which an image with a recording duty value of 20% is formed (i.e., a second region).

Figure 10B:
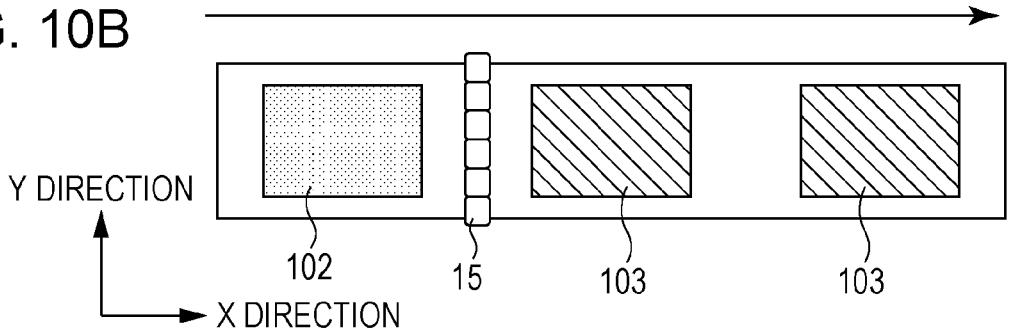

The intermediate image formed on the intermediate transfer medium 1 in the intermediate image formation process is heated by the heating section 15 to evaporate the ink solvent, thereby increasing viscosity of ink (i.e., the heating process). FIG. 10B illustrates that the intermediate images 103 have passed a heating section 15, and the intermediate image 102 will pass the heating section 15.

Figure 10C:
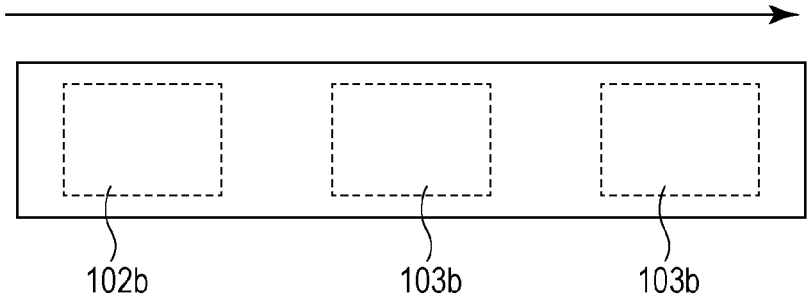

Then, in the transfer unit, the transfer belt 10 and the recording medium 16 are nipped between the transfer roller 17 and the rotary member 12, and the transfer roller 17 is driven to rotate under appropriate nip pressure. Thus, the intermediate image with ink of which viscosity has been increased appropriately in the heating process is transferred to the recording medium 16 (i.e., the transfer process). FIG. 10C illustrates regions 103*b* on the intermediate transfer medium after the intermediate images 103 are transferred (which is called a first region) and a region 102*b* on the intermediate transfer medium after the intermediate image 102 is transferred (which is called a second region).

With the mechanism described above, difference in temperature depending on the average recording duty of the entire image after the heating and transfer processes arises on the surface of the intermediate transfer medium. The average temperature after the heating process in this example is 68.5 degrees C. in the first region in which an image with a recording duty value of 90% is formed and is 86 degrees C. in the second region in which an image with a recording duty value of 20% is formed as illustrated in FIG. 5. In a strict sense, a single intermediate image has locations with different temperature; but herein the average temperature of the entire image will be discussed herein.

The average temperature of the image formation region after the transfer process is detected in the downstream of the transfer roller 17 using a temperature sensor 21 to acquire temperature information. The average temperature after the transfer process in this example is after the transfer process in this example in the first region in which an image with a recording duty value of 90% is formed is 82 degrees C. in the second region in which an image with a recording duty value of 20% is formed as illustrated in FIG. 11.

Then, the surface of the intermediate transfer medium after each transfer process is cooled to desired temperature by a cooling section 19 according to Embodiment 2 (i.e., the cooling process). This cooling process is one of important points in the present embodiment, and will be described to detail below.

Figure 10D:
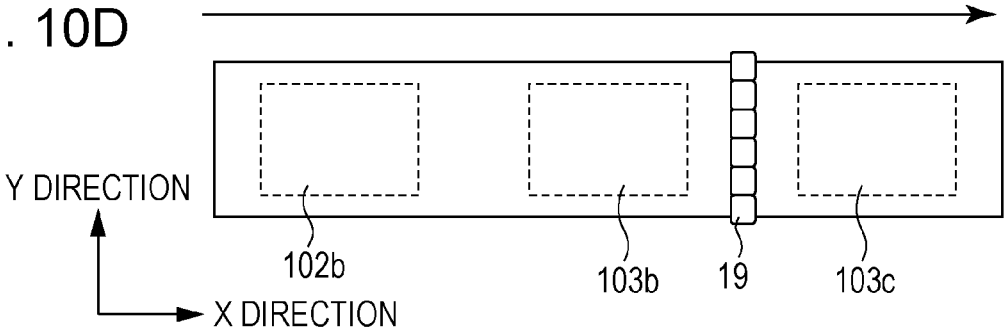

As illustrated in FIG. 10D, the cooling section 19 includes a cooling element which is divided into multiple sections and arranged linearly along the direction (Y direction) which is perpendicular to the belt moving direction (X direction). The cooling element is not necessarily arranged linearly but may be arranged in a two-dimensional matrix. Each cooling element includes a nozzle for blowing cooling medium (gas or liquid) on the surface of the intermediate transfer medium. The cooling capacity can be controlled by varying fluid flow and/or fluid temperature blown from the nozzle. Alternatively, the cooling section 19 may be a contact body which is brought into contact with the surface of the intermediate transfer medium. In that case, cooling mechanisms, such as Peltier device and a liquid path through which a cooling medium flows in order to change temperature of the contact surface. This allows independent control of a cooling amount (i.e., the surface temperature of the contact surface of the contact body).

The control unit 50 controls capability of the cooling element, in accordance with temperature information detected by the temperature sensor 21, such that each of the image formation regions on the surface of the transfer medium has an appropriate cooling amount in synchronization with the timing at which each region passes below the cooling section 19. The control unit 50 controls the cooling amount (i.e., an amount of airflow blown out of the nozzle and/or temperature of coolant gas) of the cooling element such that the cooling amount on the surface of the intermediate transfer medium of higher temperature is greater than that on the surface of the intermediate transfer medium of lower temperature. As illustrated in FIG. 10D, the control unit 50 controls the cooling element such that, when the low-temperature first region and the high-temperature second region successively pass the cooling section 19, the cooling amount on the second region is greater than that on the first region.

In this manner, cooling of each surface of the intermediate transfer medium is controlled independently in accordance with temperature of the intermediate transfer medium after being heated by the heating section. The cooling process provides substantially uniform temperature distribution on the surface of the intermediate transfer medium. Cooling is performed to an average temperature at which temperature of the intermediate transfer medium itself does not induce evaporation of the ink solvent in the subsequent recording cycle, e.g., the ambient temperature (i.e., the initial temperature). The average temperature after the cooling process in this example is 25 degrees C. in the first region in which an image with recording duty of 90% is formed and 25 degrees C. in the second region in which an image with recording duty of 20% is formed as illustrated in FIG. 11.

Instead of acquiring the temperature information by the temperature sensor 21, each surface of the intermediate transfer medium may be cooled independently in accordance with image data of the intermediate image. The control unit 50 is capable of acquiring information about the average recording duty of an image by computation from image data. A data table or a computation formula representing the correlation between the heating amount and temperature of the transfer medium surface after the heating process for each recording duty is stored in the memory of the control unit 50. The control unit 50 analyzes the image data and obtains information about the average recording duty of the image. The control unit 50 then acquires the cooling amount appropriate to the obtained recording duty with reference to the data table or the computation formula. Information about average recording duty of entire image corresponding to surface of the intermediate transfer medium after each transfer process is acquired from image data. The control unit 50 controls the cooling element such that the cooling amount of the surface of the intermediate transfer medium on which an intermediate image with relatively low recording duty is formed is greater than that on the surface of the intermediate transfer medium on which an intermediate image with relatively high recording duty is formed. This provides substantially uniform temperature distribution on the surface of the intermediate transfer medium after the transfer process.

Although difference in temperature arises between the intermediate images with different average recording duty (i.e., the first region and the second region) after the heating process as described above, that difference in temperature can be decreased by independent cooling of the first region and the second region. Therefore, occurrence of insufficient transfer in subsequent recording cycles can be prevented.

In Embodiment 2, it is possible to expand the divided regions of Embodiment 1 to the entire image and to independently control, for each of the continuously formed intermediate images, the optimum heating amount corresponding to the average recording duty of the predetermined intermediate image during the heating process. This allows the transfer with the optimum ink viscosity for each intermediate image and thereby provides a recording apparatus which is even freer from insufficient transfer.

Embodiment 3-a

Next, independent cooling of image formation regions and blank regions formed between adjacent image formation regions on an intermediate transfer medium will be described in detail.

Figure 12A:
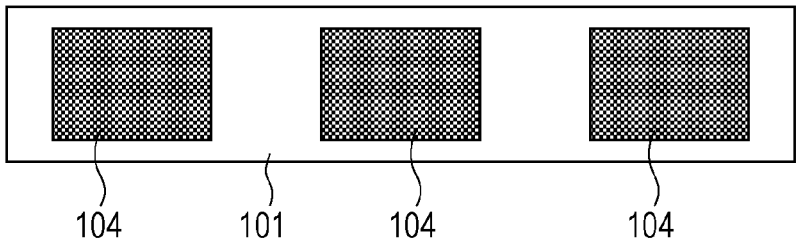
FIGS. 12A to 12D illustrate a phenomenon that surface temperature of an intermediate transfer medium varies on the location according to Embodiment 3.
Figure 13:
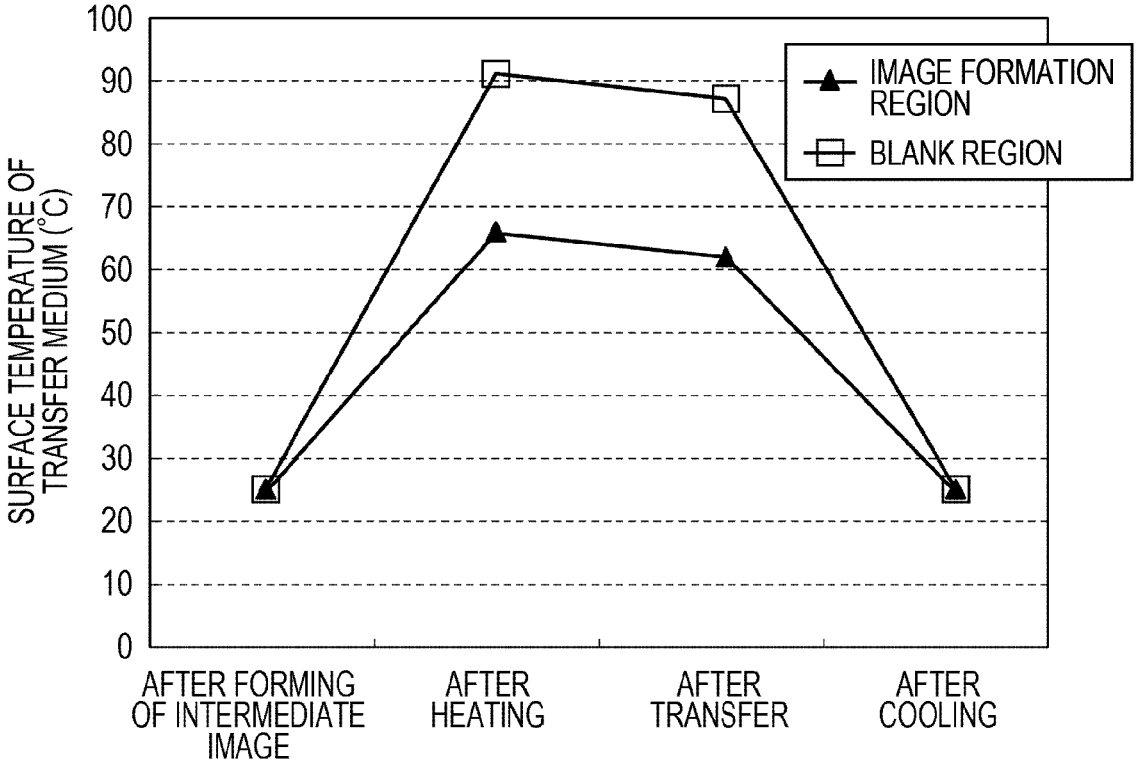
FIG. 13 is a graphic plot of transition of surface temperature of the intermediate transfer medium according to Embodiment 3.

In FIG. 12A, dot regions represent examples of intermediate images immediately after being formed on an intermediate transfer medium 1. An intermediate image 104 has average recording duty in accordance with image data (e.g., 90%). Other white colored regions represent blank regions 101. No ink is applied to the blank regions 101; thus the blank regions 101 have average recording duty of 0%. Surface temperature of the intermediate transfer medium is substantially the ambient temperature (i.e., the initial temperature) before and after the first intermediate image formation process. FIG. 13 is a graphic plot of temperature of surfaces of the intermediate transfer medium of the image formation regions and blank regions immediately after undergoing each process. In this example, temperature of the image formation regions and the blank regions before and after the intermediate image formation process is 25 degrees C.

Figure 12B:
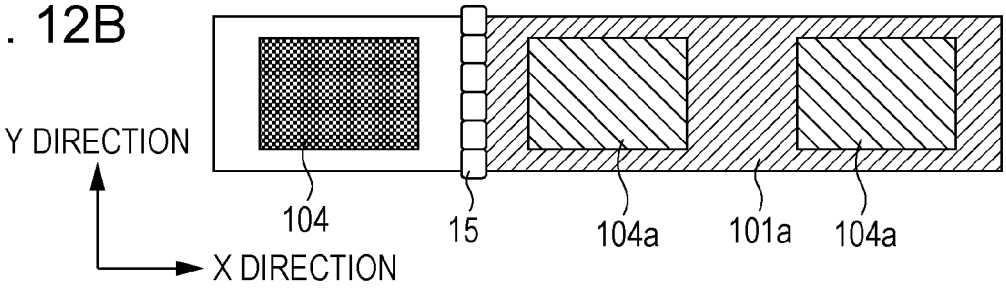

The intermediate image formed on the intermediate transfer medium 1 in the intermediate image formation process is heated uniformly by the heating section 15 to evaporate the ink solvent, thereby increasing viscosity of ink (i.e., the heating process). FIG. 12B illustrates that some intermediate images 104*a* and some blank regions 101*a* have passed the heating section 15, and the intermediate image 104 will pass the heating section 15. The heating section 15 includes a heating element which is divided into multiple sections and arranged linearly along the direction (Y direction) which is perpendicular to the belt moving direction (X direction). The heating element is not necessarily arranged linearly but may be arranged in a two-dimensional matrix.

Figure 12C:
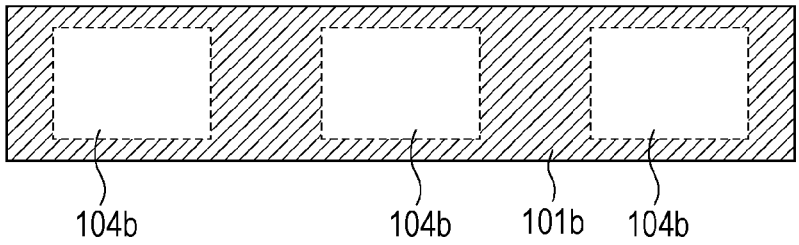

Then, in the transfer unit, the transfer belt 10 and the recording medium 16 are nipped between the transfer roller 17 and the rotary member 12, and the transfer roller 17 is driven to rotate under appropriate nip pressure. Thus, the intermediate image with ink of which viscosity has been increased appropriately in the heating process is transferred to the recording medium 16 (i.e., the transfer process). FIG. 12C illustrates region(s) 104*b* (which is called first region) and a blank region 101*b* (which is called a second region) on the intermediate transfer medium after the intermediate images 104 are transferred.

With the mechanism described above, difference in temperature between the first region and the second region after the heating and transfer processes arises on the surface of the intermediate transfer medium. An average temperature after the heating process in this example is 66 degrees C. in the image formation region (i.e., the first region) and 91 degrees C. in the blank region (i.e., the second region) as illustrated in FIG. 13. In a strict sense, a single intermediate image in the first region has locations with different temperature; but herein the average temperature of the entire image will be discussed herein.

The average temperature of the image formation region after the transfer process is detected in the downstream of the transfer roller 17 using a temperature sensor 21 to acquire temperature information. An average temperature after the transfer process in this example is 62 degrees C. in the first region and 87 degrees C. in the blank region as illustrated in FIG. 13.

In this specification, the intermediate transfer medium region in which the intermediate image is formed is called the "first region" and the intermediate transfer medium region different from the first region and including a region defined between adjacent intermediate images is called the "second region."

Then, the surface of the intermediate transfer medium after the transfer process is cooled to desired temperature by a cooling section 19 (i.e., the cooling process). This cooling process is one of important points in the present embodiment, and will be described to detail below.

Figure 12D:
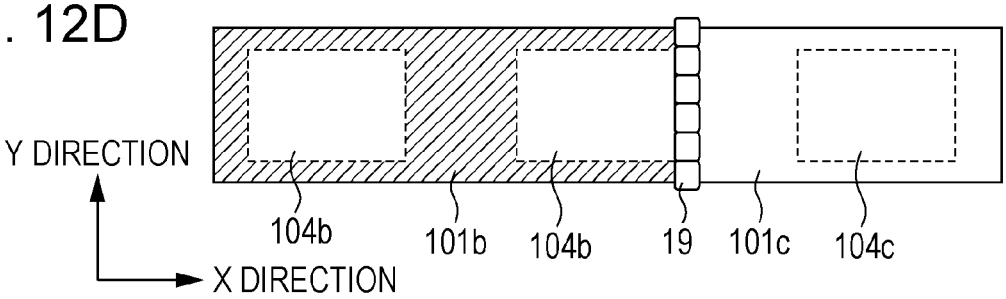

As illustrated in FIG. 12D, the cooling section 19 includes a cooling element which is divided into multiple sections and arranged linearly along the direction (Y direction) which is perpendicular to the belt moving direction (X direction). The cooling element is not necessarily arranged linearly but may be arranged in a two-dimensional matrix. Each cooling element includes a nozzle for blowing cooling medium (gas or liquid) on the surface of the intermediate transfer medium. The cooling capacity can be controlled by varying fluid flow and/or fluid temperature blown from the nozzle. Alternatively, the cooling section 19 may be a contact body which is brought into contact with the surface of the intermediate transfer medium. In that case, cooling mechanisms, such as Peltier device and a liquid path through which a cooling medium flows in order to change temperature of the contact surface. This allows independent control of a cooling amount (i.e., the surface temperature of the contact surface of the contact body).

The control unit 50 controls capability of the cooling element, in accordance with temperature information detected by the temperature sensor 21, such that the first region and the second region have an appropriate cooling amount in synchronization with the timing at which these regions pass below the cooling element of the cooling section 19. The control unit 50 controls the cooling amount (i.e., an amount of airflow blown out of the nozzle and/or temperature of coolant gas/or temperature of a contact surface of a cooling roller if used) of the cooling element such that the cooling amount of the intermediate transfer medium of higher temperature is greater than that of the intermediate transfer medium of lower temperature. As illustrated in FIG. 12D, the control unit 50 controls the cooling element such that a cooling amount in accordance with temperature is provided to the low-temperature first region when it passes the cooling section 19 and a cooling amount greater than that for the first region is provided to the high-temperature second region when it passes the cooling section 19.

In this manner, each surface of the intermediate transfer medium is cooled independently in accordance with temperature of the intermediate transfer medium after being heated by the heating section. The cooling process provides substantially uniform temperature distribution on the surface of the intermediate transfer medium. Cooling is performed to an average temperature at which temperature of the intermediate transfer medium itself does not induce evaporation of the ink solvent in the subsequent recording cycle, e.g., the ambient temperature (i.e., the initial temperature). An average temperature after the cooling process in this example is 25 degrees C. in the first region and 25 degrees C. in the second region as illustrated in FIG. 13.

Instead of acquiring the temperature information by the temperature sensor 21, each surface of the intermediate transfer medium may be cooled independently in accordance with the image data of the intermediate image. The control unit 50 is capable of acquiring information about the average recording duty value of the image from the image data by computation. A data table or a computation formula representing the correlation between the heating amount and temperature of the transfer medium surface after the heating process for each recording duty is stored in the memory of the control unit 50. The control unit 50 analyzes the image data and obtains information about the average recording duty of the image. The control unit 50 then acquires the cooling amount appropriate to the obtained recording duty with reference to the data table or the computation formula. No ink is applied to the blank regions; thus the blank regions have average recording duty of 0%. The control unit 50 controls the cooling element such that the cooling amount in accordance with the average recording duty of the entire image is provided to the first region and that the cooling amount in the first region is greater than that in the second region. This provides substantially uniform temperature distribution on the surface of the intermediate transfer medium after the transfer process.

Although difference in temperature arises between the first region which is the image formation region and the second region which is the blank region after the heating process as described above, that difference in temperature can be decreased by independent cooling of the first region and the second region. Therefore, occurrence of insufficient transfer in subsequent recording cycles can be prevented.

Embodiment 3-b

Embodiment 2 of the present invention will be described. Embodiment 3-b differs from Embodiment 1 in the control of the heating process and has the entire configuration which is the same as that illustrated in FIG. 2. In Embodiment 2, the intermediate transfer medium is not heated uniformly in the heating process as in the configuration of Embodiment 1; but a heating section 15 is controlled to be driven to provide different heating amounts to an image formation region (i.e., a first region) and a blank region (i.e., a second region). In particular, the heating unit is controlled such that the heating amount provided to the first region is greater than that provided to the second region.

The control unit 50 acquires information about average recording duty of the image formation region (i.e., the first region) in accordance with image data. The control unit 50 then computes an appropriate heating amount in accordance with the average recording duty and an expected value of temperature of a surface of the intermediate transfer medium when provided with the computed heating amount. A data table or a computation formula representing the correlation between the heating amount and temperature of the transfer medium surface after the heating process for each recording duty is stored in the memory of the control unit 50. The control unit 50 analyzes the image data and obtains information about the average recording duty of the image. The control unit 50 then acquires the heating amount and temperature of a surface of the intermediate transfer medium appropriate to the obtained recording duty with reference to the data table or the computation formula. The heating amount for the blank region (i.e., the second region) is determined such that the first region and the second region have substantially the same temperature on the surface of the intermediate transfer medium after the heating process. In particular, the heating amount for the first region is greater than that for the second region.

The control unit 50 drives the heating element of the heating section 15 in synchronization with the movement of the intermediate transfer medium such that the heating amounts determined independently for the first region and the second region are applied. As a result of the heating control, difference in temperature between the first region and the second region becomes small. For this reason, the cooling amounts produced by the cooling section 19 are not necessarily different between the first region and the second region. In order for a further decrease in the difference in temperature which has not been eliminated by the heating control, cooling of the first region and the second region may be independently controlled by the cooling section 19.

Figure 14:
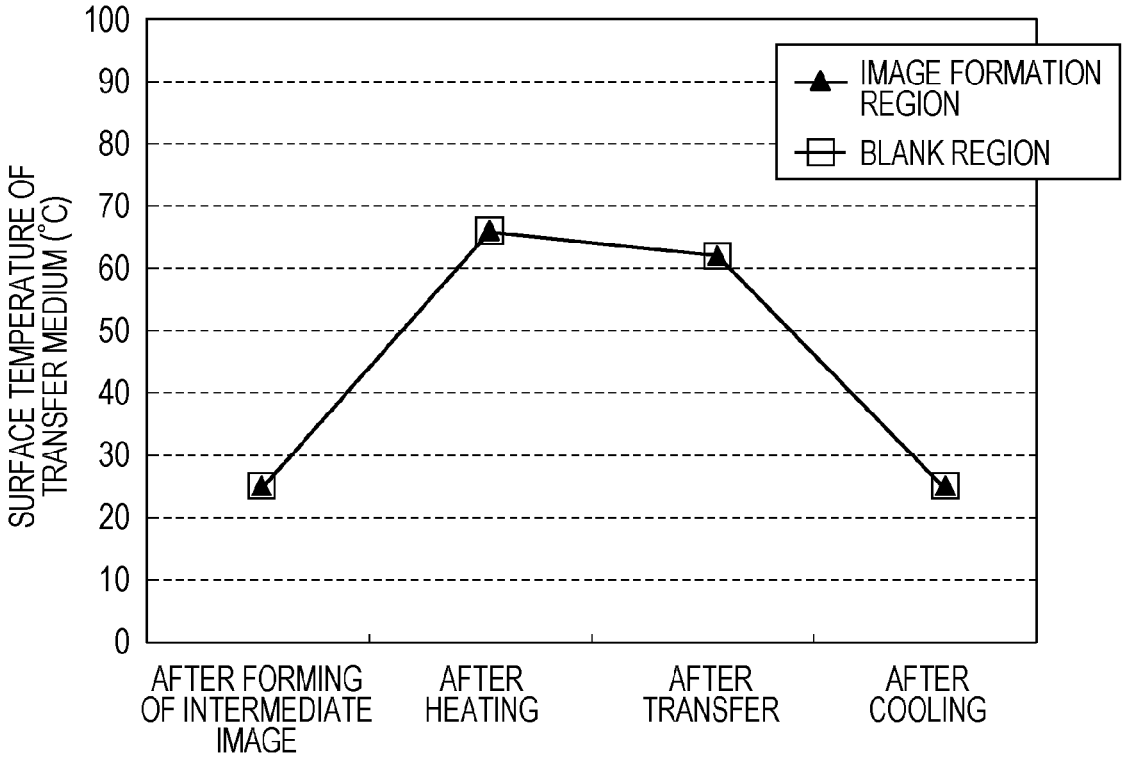
FIG. 14 is a graphic plot of transition of surface temperature of the intermediate transfer medium according to Embodiment 3.

FIG. 14 is a graphic plot of transition of temperature on the surface of the intermediate transfer medium according to Embodiment 2. Temperature before and after the intermediate image formation process is 25 degrees C. in both an image formation region (i.e., a first region) and a blank region (i.e., a second region) as in the configuration of Embodiment 1. Temperature after the heating process is 66 degrees C. in both the first region and the second region. Since the first region and the second region are uniformly heated in Embodiment 1, difference in temperature arises after the heating process. In Embodiment 2, however, the first region and the second region are heated independently and provided with different heating amounts; therefore, difference in temperature after the heating process between the first region and the second region is small. After the subsequent transfer process, difference in temperature is kept small and the temperature during the transfer process is 62 degrees C. in both the first region and the second region. In the cooling process, the first region and the second region are cooled with a uniform cooling amount. As a result, temperature of the first region and the second region return to 25 degrees C.

In each embodiment, the heating section 15 includes multiple heating elements arranged in the Y direction and the cooling section 19 includes multiple cooling elements arranged in the Y direction. Each of the heating and cooling elements can be driven independently under the control of the control unit 50. With this configuration, independent heating or cooling can be performed not only along the X direction but also along the Y direction by dividing the regions on the intermediate transfer medium.

In particular, when the intermediate image 104 passes below the cooling section 19 or the heating section 15, the cooling elements or the heating elements facing the first region and those elements facing the blank region (i.e., a part of the second region), among the cooling elements or the heating elements arranged in the Y direction, have different cooling amount or heating amount. That is, the second region includes a region located between adjacent intermediate images and includes a region which is different from the first region along the width direction of the intermediate transfer medium. In the example of Embodiment 1, the cooling amount of the cooling element which faces the second region is greater than that of the cooling element which faces the first region. In the example of Embodiment 2, the heating amount of the heating element which faces the second region is smaller than that of the heating element which faces the first region. Note that the second region is not used for the recording and thus may not be subject to heating or cooling. Independent heating and/or cooling of the first region and the second region can reduce difference in temperature throughout the transfer medium; thus, occurrence of insufficient transfer in subsequent recording cycles can be prevented more reliably.

Embodiment 4

Figure 15:
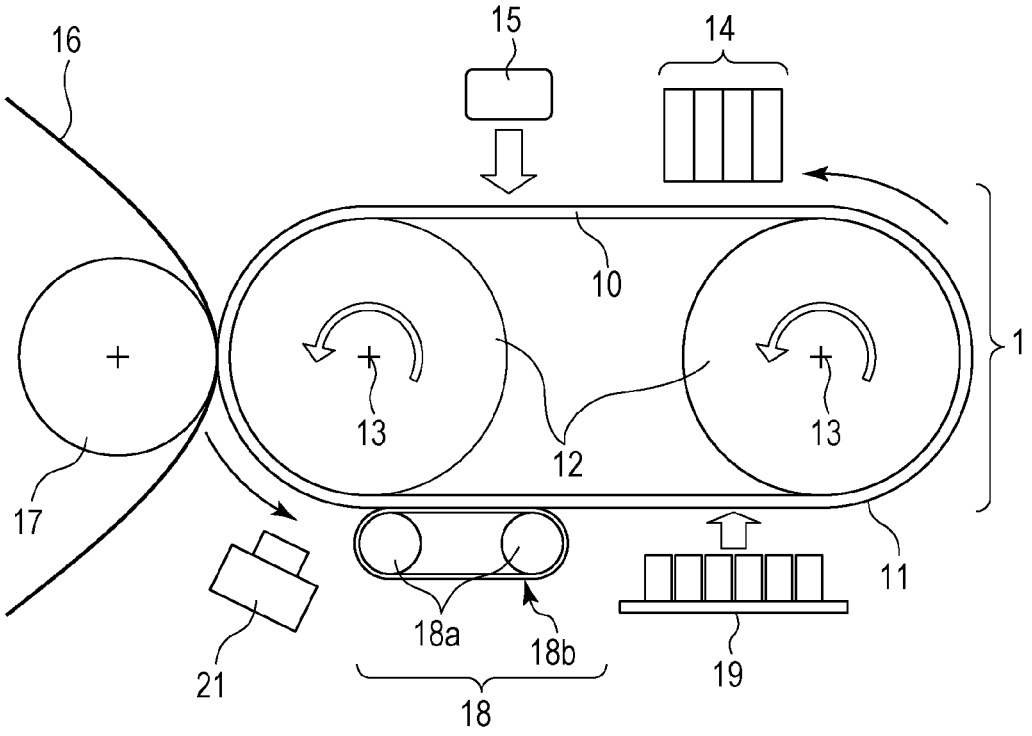
FIG. 15 illustrates, in a sectional view, an entire configuration of a recording apparatus according to Embodiment 4.

FIG. 15 illustrates an entire configuration of a recording apparatus with a transfer inkjet recording system according to Embodiment 4. Embodiment 4 differs from Embodiment 1 in a cooling process after the transfer process; other components are the same. An auxiliary cooling section 18 is provided downstream of a transfer roller 17 and upstream of a cooling section 19. The auxiliary cooling section 18 includes two rotary members 18*a* and a cooling belt 18*b*. The cooling belt 18*b* surface contacts a transfer belt 10 of an intermediate transfer medium 1 and is driven to rotate by the transfer belt 10, whereby cools the transfer belt 10 uniformly. Thus, a cooling unit is provided with two cooling sections: the cooling section 18 which cools the intermediate transfer medium uniformly, and the cooling section 19 which cools divided regions of the intermediate transfer medium independently.

The intermediate image formation process, the heating process and the transfer process of Embodiment 4 are the same as those of Embodiment 1.

Subsequently, a surface of the intermediate transfer medium is cooled uniformly by the auxiliary cooling section 18. The cooling amount of the auxiliary cooling section 18 is determined such that temperature of a location at which temperature rise in the heating process is the smallest (recording duty: 90%) is lowered to about ambient temperature (i.e., the initial temperature). Surface temperature of the cooling belt 18*b* is determined in consideration of, for example, thermal conductivity of the cooling belt 18*b*, the transfer belt 10 and the surface layer 11, and thermal resistance of the contact surface.

Figure 16:
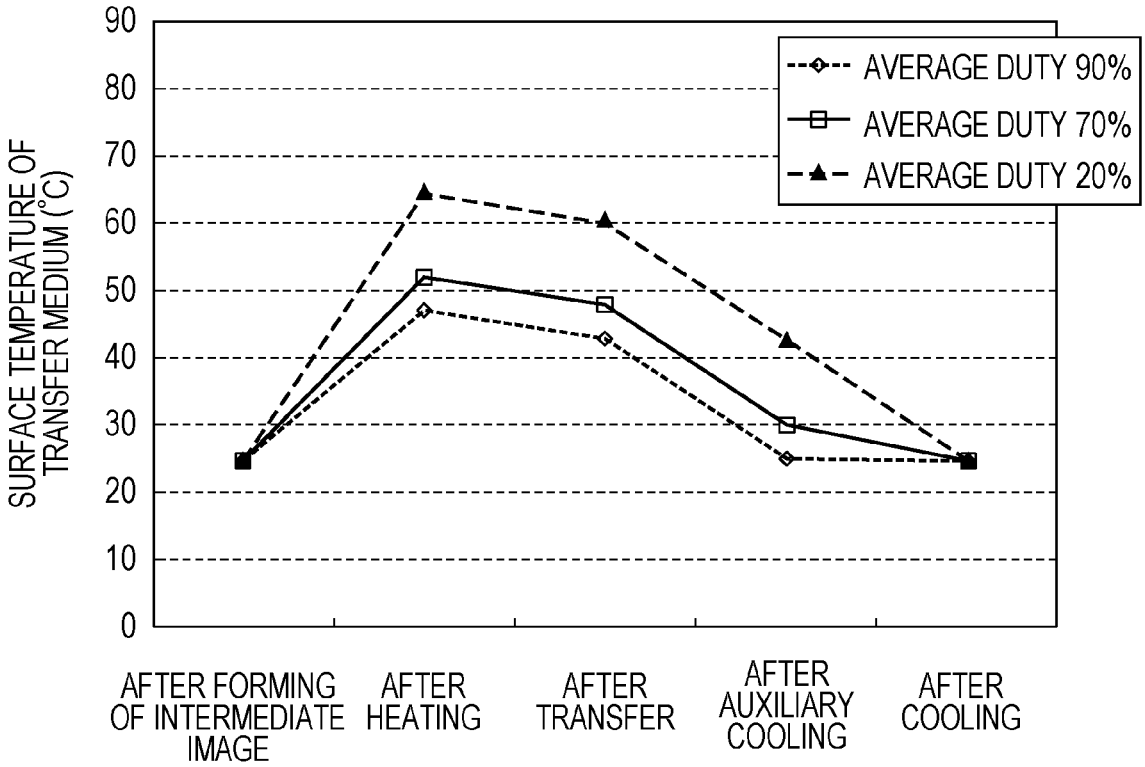
FIG. 16 is a graphic plot of transition of surface temperature of an intermediate transfer medium of each recording duty immediately after undergoing each process according to Embodiment 4.

FIG. 16 is a graphic plot of transition of the surface temperature of the intermediate transfer medium of each recording duty immediately after undergoing each process. Temperature before and after the intermediate image formation process, temperature after the heating process, and temperature after the transfer process are the same as those of Embodiment 1. Temperature immediately after the uniform cooling by the auxiliary cooling unit 18 is 25 degrees C. in a region with recording duty of 90%, 30 degrees C. in a region with recording duty of 70% and is 42.5 degrees C. in a region with recording duty of 20%. At this time, difference still exists in temperature of the intermediate transfer medium in accordance with recording duty.

In the next cooling process by the cooling section 19, each of the divided regions is independently cooled as in the configuration of Embodiment 1. As a result, temperature of a region after the transfer process of the intermediate image returns to substantially uniform temperature (i.e., 25 degrees C.).

Embodiment 4 produces the following operation and effect in addition to that of Embodiment 1. That is, since the uniformly cooling process by the auxiliary cooling section 18 (i.e., a first cooling section) is included, it is necessary for the cooling section 19 (i.e., a second cooling section) to eliminate only small difference in temperature; thus, load of each cooling element provided in the cooling section 19 can be reduced.

Note that the auxiliary cooling section 18 of Embodiment 4 may be added to Embodiment 2 and Embodiment 3. In that case, the processes are performed in this order: division heating, transfer, auxiliary cooling and division cooling.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2010-238579 filed Oct. 25, 2010, No. 2010-238685 filed Oct. 25, 2010 and No. 2010-238686 filed Oct. 25, 2010, which are hereby incorporated by reference herein in their entirety.

What is claimed is:

1. A recording apparatus, comprising:

an intermediate transfer medium;

a recording head configured to apply ink to the intermediate transfer medium in accordance with image data to form an intermediate image;

a heating unit configured to heat the intermediate image formed on the intermediate transfer medium;

a transfer unit configured to transfer the intermediate image heated by the heating unit to a recording medium; and a cooling unit configured to cool the intermediate transfer medium heated by the heating unit, wherein the cooling unit is further configured to cool multiple locations of the intermediate transfer medium independently in accordance with the temperature of the intermediate transfer medium after being heated by the heating unit or in accordance with the image data.

2. The recording apparatus according to claim 1, wherein the cooling unit is further configured to cool the multiple locations independently in accordance with data corresponding to each of the multiple locations such that a difference in temperature among the multiple locations after being heated by the heating unit is small.

3. The recording apparatus according to claim 2, wherein the cooling unit is further configured to acquire information about recording duty corresponding to each of the multiple locations from the image data, and cool such that a cooling amount of a location with relatively low recording duty is greater than that of a location with relatively high recording duty.

4. The recording apparatus according to claim 1, wherein the cooling unit is further configured to independently cool multiple locations in a region in which the intermediate image is formed on the intermediate transfer medium in accordance with temperature of the intermediate transfer medium after being heated by the heating unit or in accordance with the image data.

5. The recording apparatus according to claim 4, wherein the acquisition unit includes a temperature sensor which detects temperature of a surface of the intermediate transfer medium.

6. The recording apparatus according to claim 1, further comprising an acquisition unit configured to acquire information about temperature of the intermediate transfer medium after being heated by the heating unit, wherein the cooling unit cools the multiple locations independently in accordance with information about temperature acquired by the acquisition unit such that difference in temperature among the multiple locations after being heated by the heating unit is small.

7. The recording apparatus according to claim 6, wherein the cooling unit is configured to cool, in accordance with the information about the temperature corresponding to each of the multiple locations, such that the cooling amount of a location of high temperature is greater than that of a location with low temperature.

8. The recording apparatus according to claim 1, wherein the cooling unit includes multiple cooling elements each of which can be controlled independently, each cooling element configured to blow fluid on the surface of the intermediate transfer medium from a nozzle, or bring its contact surface into contact with the surface of the intermediate transfer medium.

9. The recording apparatus according to claim 1, wherein the heating unit is configured to independently heat multiple locations in a region in which the intermediate image is formed in accordance with the image data.

10. The recording apparatus according to claim 9, wherein the heating unit is configured to acquire information about recording duty corresponding to each of the multiple locations from the image data, and is configured to heat such that a heating amount of a location with relatively high recording duty is greater than that of a location with relatively low recording duty.

11. The recording apparatus according to claim 9, wherein the heating unit includes multiple heating elements each of which can be controlled independently.

12. The recording apparatus according to claim 1, wherein the cooling unit includes a first cooling section which is configured to uniformly cool a region in which the intermediate image of the intermediate transfer medium is formed after the transfer by the transfer unit, and a second cooling section which is configured to independently cool the multiple locations in accordance with the temperature after the cooling by the first cooling section or in accordance with the image data.

13. The recording apparatus according to claim 1, wherein, when multiple intermediate images are formed on the intermediate transfer medium, the cooling unit is configured to independently control cooling of the first region and the second region by the cooling unit such that difference in temperature between a first region in which a first intermediate image is formed and a second region in which a second intermediate image subsequent to the first intermediate image is formed is small.

14. The recording apparatus according to claim 13, wherein the cooling unit is configured to acquire information about an average recording duty of the first intermediate image and the second intermediate image and cools such that a cooling amount of a region in which the intermediate image with relatively low average recording duty is greater than that of a region in which the intermediate image with relatively high average recording duty.

15. The recording apparatus according to claim 14, wherein the cooling unit is configured to determine the cooling amount using a data table or a computation formula representing correlation of the heating amount and surface temperature of the transfer medium after being heated for each average recording duty of the intermediate image.

16. The recording apparatus according to claim 13, wherein the heating unit is configured to acquire information about the average recording duty of the first intermediate image and the second intermediate image, and is configured to heat such that the heating amount of the first intermediate image with relatively high average recording duty is greater than that of the second intermediate image with relatively low average recording duty.

17. The recording apparatus according to claim 16, wherein the second region includes a region located between the adjacent intermediate images and includes a region which is different from the first region along the width direction of the intermediate transfer medium.

18. The recording apparatus according to claim 1, further comprising a control unit which is configured to control, when the multiple intermediate image are formed on the intermediate transfer medium, at least one of the cooling unit to cause the cooling amount of the second region to be greater than that of the first region and the heating unit to cause the heating amount of the first region to be greater than that of the second region in the first region in which the intermediate image of the intermediate transfer medium is formed and in the second region which is different from the first region and includes a region disposed between adjacent the intermediate images.

* * * * *